US005855023A

United States Patent [19]

Clingenpeel et al.

[11] Patent Number: 5,855,023

[45] Date of Patent: Jan. 5, 1999

[54] VENTILATED HAT

[76] Inventors: Herman L. Clingenpeel; Wilberta Clingenpeel, both of 364 Service Church, Aliquippa, Pa. 15001

[21] Appl. No.: 738,479

[22] Filed: Oct. 28, 1996

[51] Int. Cl.[6] ..... A42B 1/22

[52] U.S. Cl. ..... 2/7; 2/181.6; 2/182.1; 2/182.3; 2/182.8; 2/183; 2/195.2; 2/209.5; 2/DIG. 1

[58] Field of Search ..... 2/7, 181, 181.2, 2/182.1, 183, 209.5, DIG. 1, 195.2, 209.7, 181.6, 182.3, 182.7, 182.8, DIG. 11

[56] References Cited

U.S. PATENT DOCUMENTS

| | | | |
|---|---|---|---|
| 50,285 | 10/1865 | Smith . | |
| 707,784 | 8/1902 | Johnson . | |
| 1,105,400 | 7/1914 | Burke . | |
| 1,486,102 | 3/1924 | Monton . | |
| 1,625,670 | 4/1927 | Maxwell . | |
| 1,894,213 | 1/1933 | Ostolaza | 2/182.1 |
| 1,988,101 | 1/1935 | Wittcoff | 2/176 |
| 1,990,096 | 2/1935 | Rothchild | 2/176 |
| 1,997,708 | 4/1935 | Vriwal | 2/178 |
| 2,349,471 | 5/1944 | Starbeck . | |
| 2,870,449 | 1/1959 | Bailey . | |
| 4,989,270 | 2/1991 | Boughten | 2/171.7 |
| 5,495,622 | 3/1996 | Kaufmann | 2/175.1 |

*Primary Examiner*—Diane L. Biefeld

[57] ABSTRACT

A hat includes a band connected to a first side of the hat and configured to be releasably and adjustably connectable to a second side of the hat. The band is positioned and configured to leave a gap between a front of the hat and a wearer's head when the hat is worn. The hat includes an open mesh segment.

12 Claims, 6 Drawing Sheets

VENTILATED HAT

BACKGROUND OF THE INVENTION

1. Field of the Invention

The present invention relates to apparel, specifically to a hat with structure to enhance ventilation of a wearer's head.

2. Description of the Related Art

Various attempts have been made in the prior art to make hats more comfortable through permitting ventilation of the wearer's head. Usually, these attempts have involved constructing the hat out of light material or manufacturing at least part of the hat out of open mesh. No serious attempt has been made to construct a hat which uses natural convection and natural air velocity to ventilate a significant area of a person's head in a truly effective way.

SUMMARY OF THE INVENTION

The ventilated hat of the present invention includes a band connected to a first side of the hat and configured to be releasably and adjustably connectable to a second side of the hat. The band is positioned and configured to leave a gap between a front of the hat and a wearer's head when the hat is worn. The hat includes an open mesh segment.

Accordingly, several objects and advantages of the present invention are:

a. to provide a ventilated hat which naturally ventilates a significant portion of a user's head; and b. to provide an apparatus which can be used in an existing hat to provide ventilation.

Still further objects and advantages will become apparent from the ensuing description and drawings.

DETAILED DESCRIPTION

Figure 1:
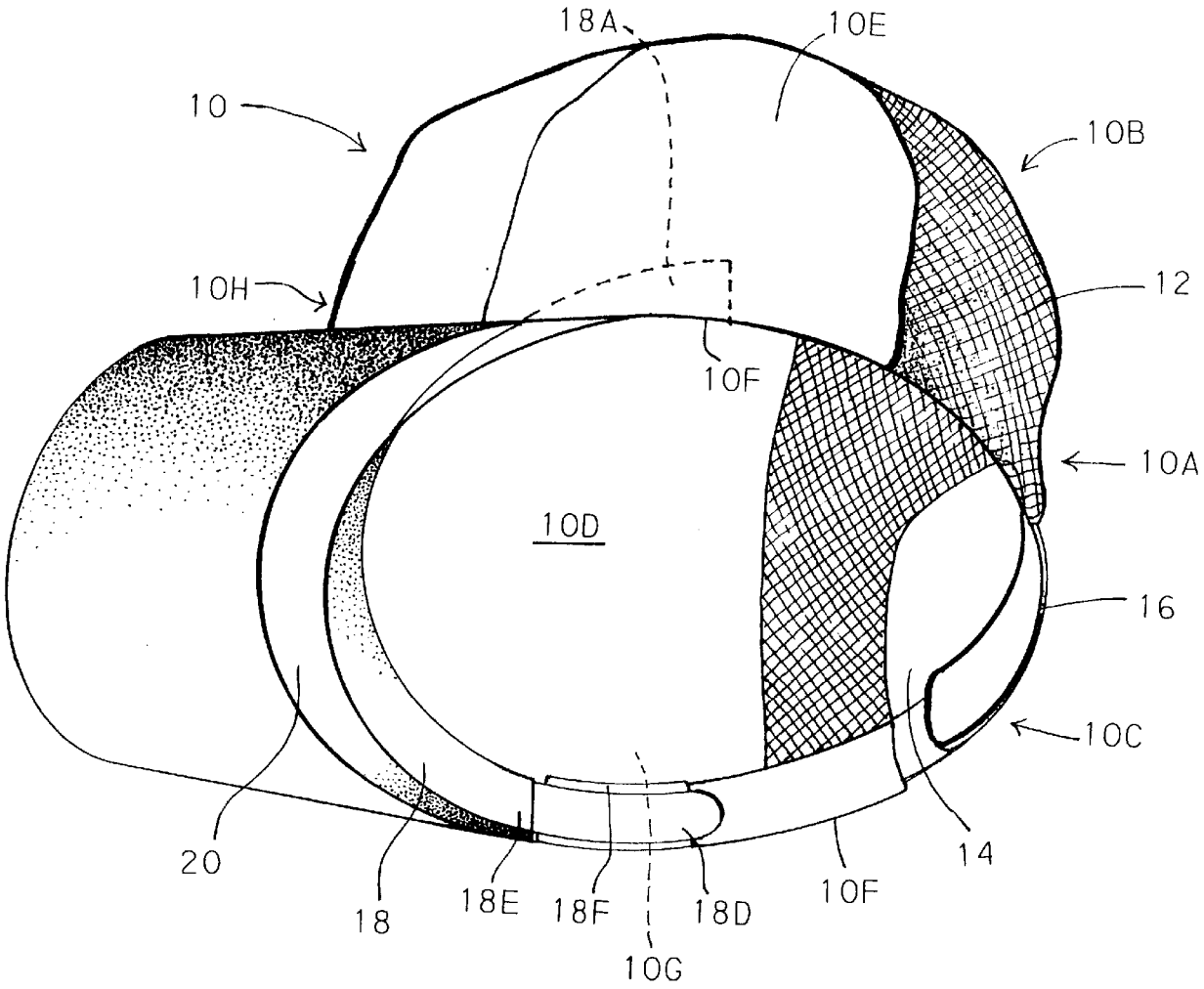
FIG. 1 is a bottom perspective view of the ventilated hat.

FIG. 1 is a bottom perspective view of a ventilated hat 10. An open mesh segment 12 covers a portion of the rear 10A and the top rear 10B of the hat 10. The hat 10 further includes structure forming an opening 14 through the bottom rear 10C of the hat 10, configured and positioned in a conventional manner just above a conventional adjustable strap 16.

A band 18 includes a first band end 18A attached to the inside 10D of the hat 10, at the first side 10E of the hat 10, adjacent a bottom edge 10F of the hat 10. The band 18 is constructed in a conventional manner of cloth stitched to interfacing.

Figure 1A:
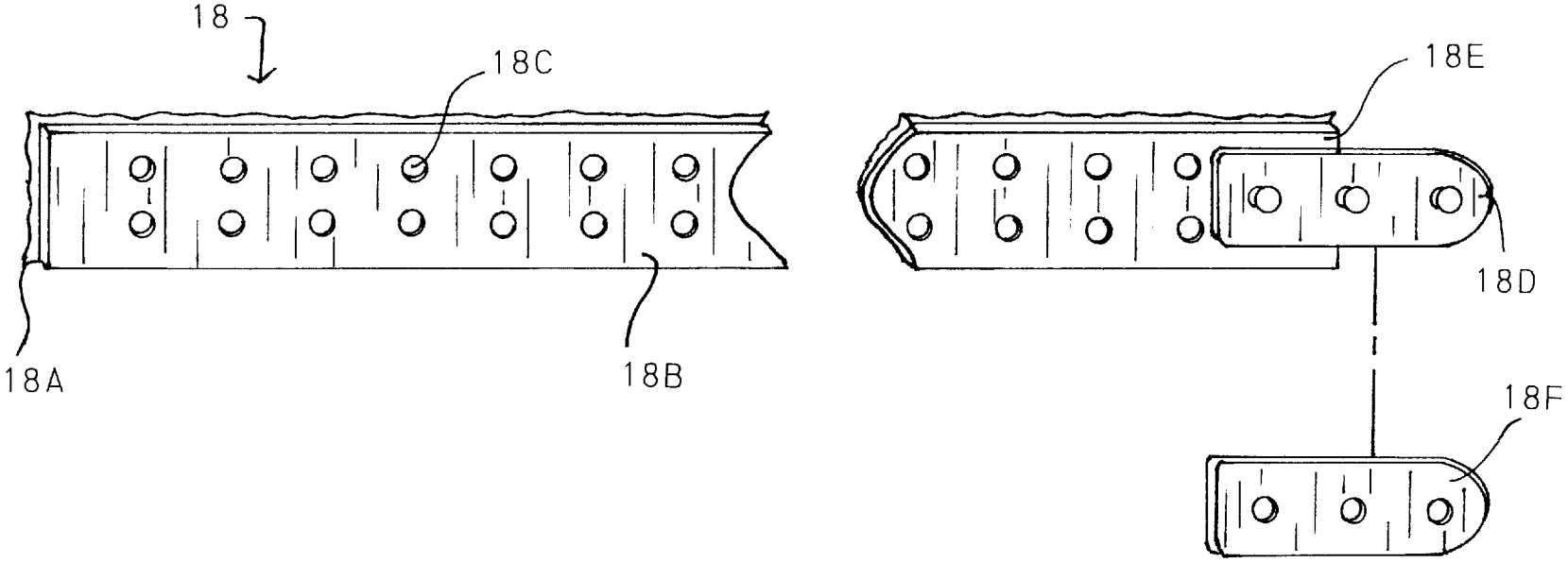
FIG. 1A is a perspective view of the band, shown apart from the hat for clarity.

FIG. 1A is a perspective view of the band 18, shown apart from the hat 10 for clarity. A flexible plastic backing 18B may be attached to the band 18, along its entire length. The backing 18B is positioned on the surface of the band 18 facing away from a wearer's head when the hat 10 is worn. The backing 18B may include structure forming ventilating apertures 18C there-through, distributed along the length thereof.

Referring to both FIGS. 1 and 1A, a male adjustable connector 18D is attached to a second band end 18E. The male adjustable connector 18D and a female adjustable connector 18F are configured to releasably and adjustably connect to each other. The female adjustable connector 18F is fixably attached to the inside 10D of the hat 10 at a second side 10G of the hat 10 near the bottom edge 10F of the hat 10. In FIG. 1A, the female adjustable connector 18F is shown apart from the hat 10 for clarity.

The band 18 is positioned and configured to extend toward the front 10H of the hat 10, leaving a gap 20 between the band 18 and the front 10H of the hat 10 when the male adjustable connector 18D and the female adjustable connector 18F are connected to each other. The male and female adjustable connectors 18D, 18F may also be connected to each other such that the band 18 is immediately adjacent the interior side of the front 10H of the hat 10, and the gap 20 is non-existent. The hat 10 would be worn in this manner whenever someone does not wish to take advantage of the ventilation properties, for example in cool, dry weather.

Figure 2:
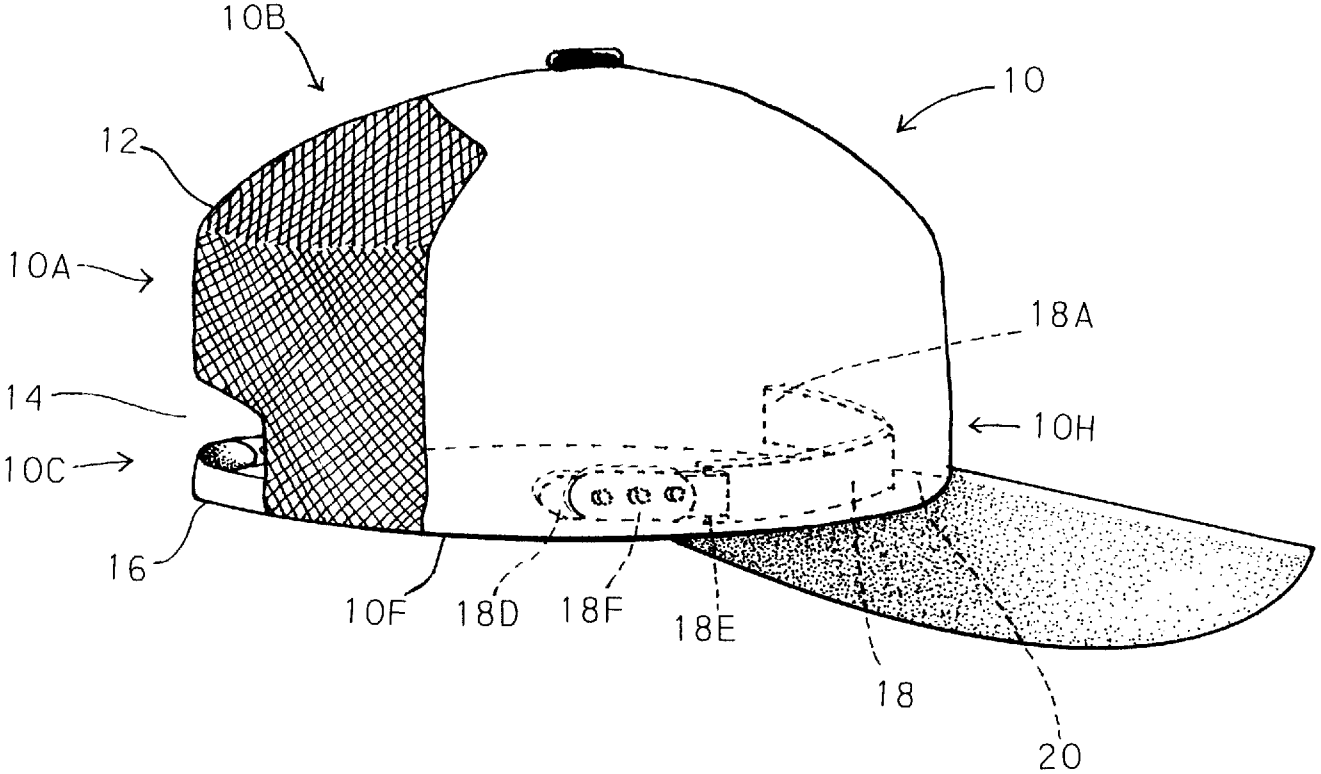
FIG. 2 is a side perspective view of the ventilated hat.

FIG. 2 is a side perspective view of the hat 10. The shape of the open mesh segment 12 which covers a portion of the rear 10A and the top rear 10B of the hat 10 is more readily seen in this view. The open mesh segment 12 is symmetrical across the center of the rear 10A of the hat 10; in other words, a view of the hat 10 from the opposite side of FIG. 2 would show a mirror image of the open mesh segment 12. The band 18, male and female adjustable connectors 18D, 18F, and the gap 20 between the band 18 and the front 10H of the hat 10 are indicated in FIG. 2 to give a further understanding of the relationship of these various elements by showing them from a different viewpoint.

Figure 3:
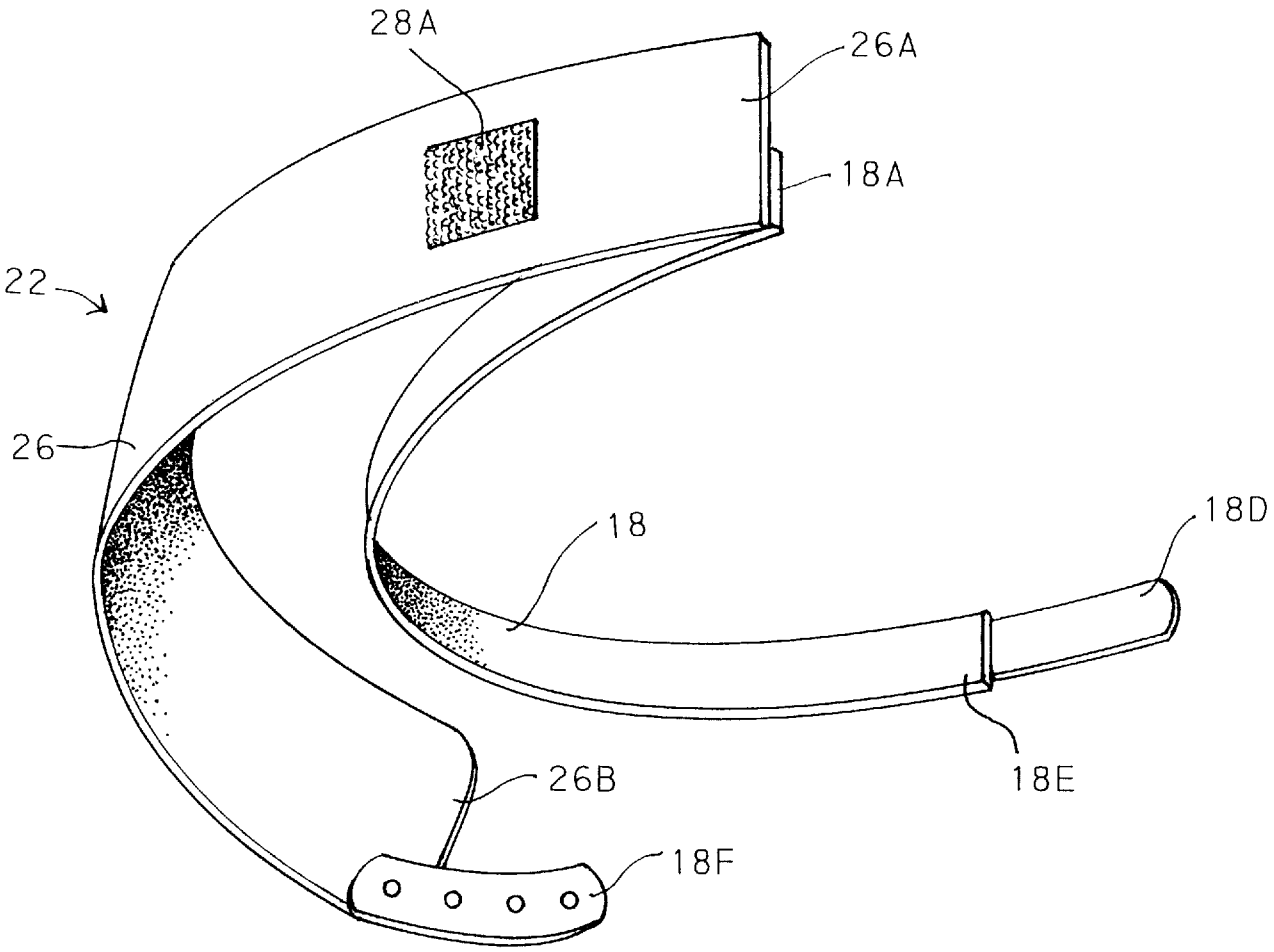
FIG. 3 is a perspective view of an insert for a conventional hat.
Figure 4:
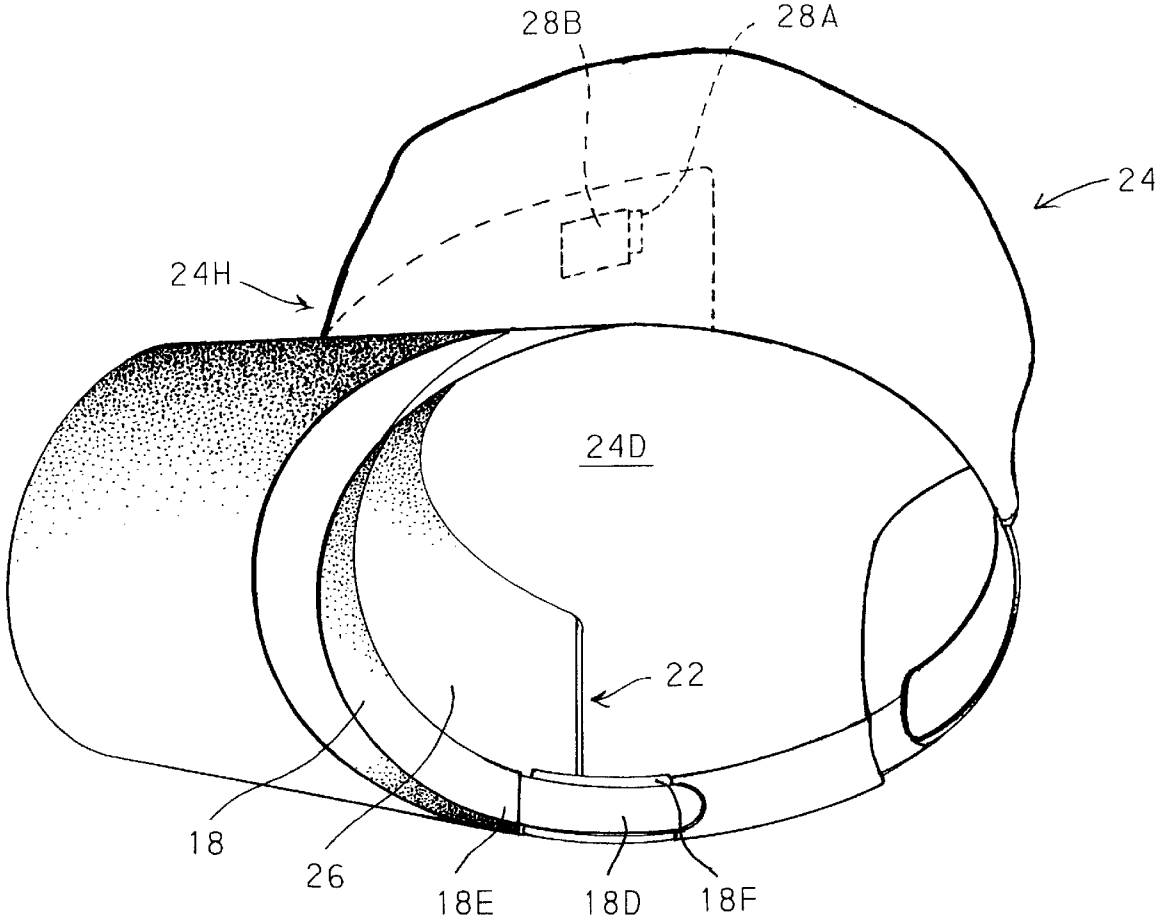
FIG. 4 is a bottom perspective view of the insert attached to the inside of the conventional hat.

FIG. 3 is a perspective view of an insert 22 for a conventional hat 24. FIG. 4 is a bottom perspective view of the insert 22 attached to the inside 24D of the conventional hat 24. The insert 22 includes a substantially planar, elongated stiffener 26. The stiffener 26 is preferably made of plastic, and is bendable to conformingly fit to the inside 24D of the front 24H of the conventional hat 24. The band 18 is configured the same as in the previously described embodiment, including the male adjustable connector 18D attached to the second band end 18E. The first band end 18A is connected to a first stiffener end 26A. The female adjustable connector 18F is connected to a second stiffener end 26B. The band 18 may include the flexible plastic backing 18B as shown in FIG. 1A and as described for the previous embodiment.

The stiffener 26 may include any type of first cooperative connector 28A thereon, for removably connecting the stiffener to a second cooperative connector 28B attached to the inside 24D of the conventional hat 24. The first and second cooperative connectors 28A, 28B may be any type of well known fastening system such as male and female snaps, buttons and button holes, or hook-and-loop.

Similarly to the previous embodiment, the band 18 is positioned and configured to extend toward the front 24H of the conventional hat 24, leaving the gap 20 between the band 18 and the front 24H of the conventional hat 24 when the stiffener 26 is attached to the inside 24D of the front 24H of the conventional hat 24 and the male adjustable connector 18D and the female adjustable connector 18F are connected to each other.

It is within the scope of the invention that the two described embodiments herein may be combined in various ways. For example, the ventilated hat 10 may include structure for stiffening the front 10H of the hat 10 in addition to or in lieu of standard methods such as interfacing. The structure for stiffening the front 10H of the hat 10 may be similar to the stiffener 26, and may be hidden from view by an additional layer of fabric on the inside 10D of the hat 10, or may be exposed, similar to FIG. 4. The stiffener 26 may be permanently attached, as by stitching or other conventional method to the conventional hat 24. The stiffener 26 may be removably or permanently attached as described to a hat which includes the open mesh segment 12.

Figure 5:
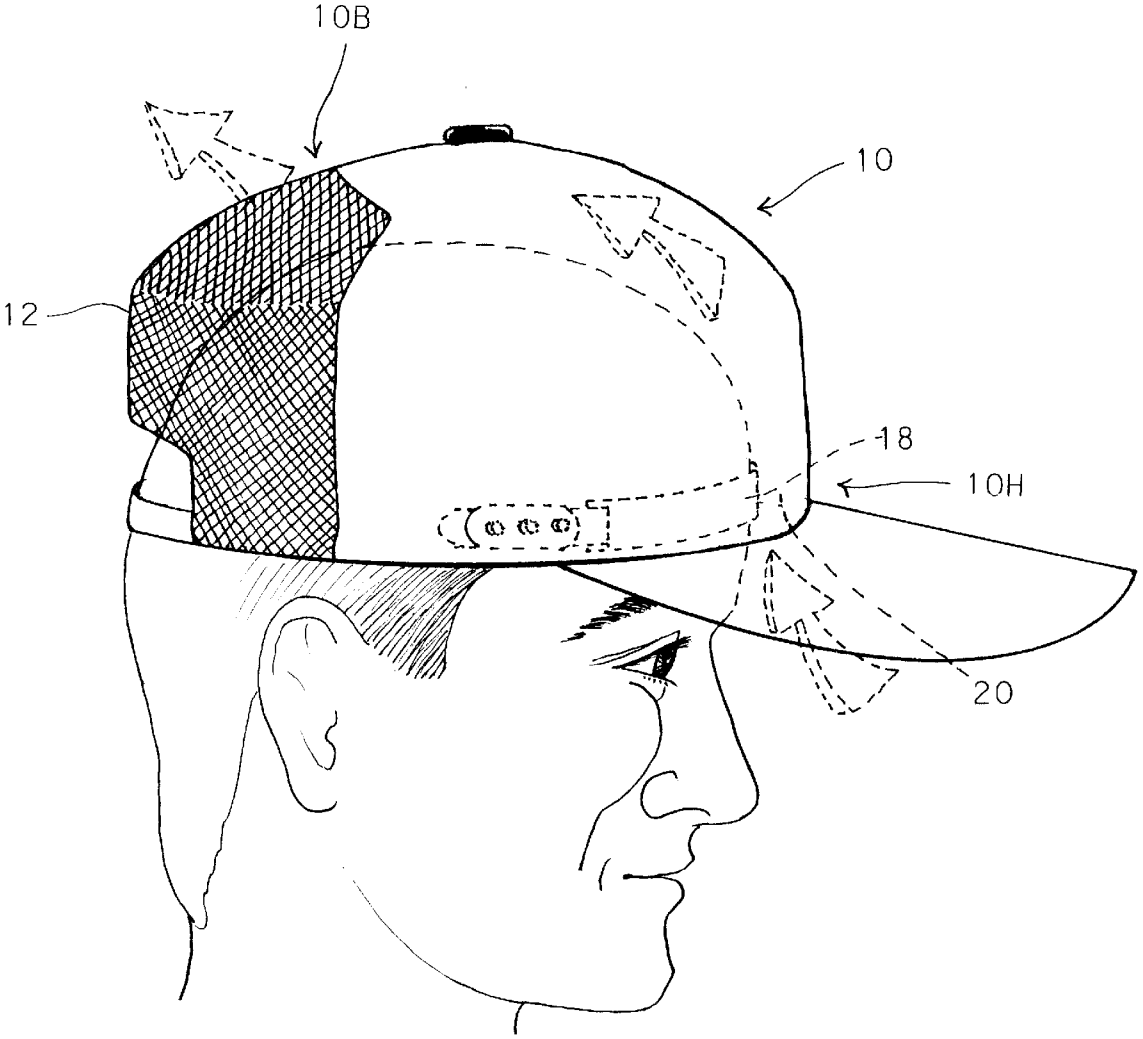
FIG. 5 is a side perspective view of the ventilated hat being worn.

As shown in FIG. 5, when the ventilated hat 10 is worn with the gap 20 between the band 18 and the front 10H of the hat 10, air will naturally flow into the hat 10 through the gap 20, then over the wearer's head, and then out of the hat 10 through the open mesh segment 12. The air movement is signified by the arrows in FIG. 5. This air movement occurs naturally by convection, because a human head is almost always warmer than ambient air in most climates under most conditions. Relatively cooler air enters through the gap 20, becomes warmed by the wearer's head, then rises naturally through the open mesh segment 12 at the top rear 10B of the hat 10. This air movement can also occur due to natural air velocity due to wind or movement of the wearer. Air blowing naturally at the front of the cap will become caught under the bill of the cap and flow into and out of the hat as described above. For example, when driving a tractor, the air would flow in this manner. Wind can also cause the air through the cap to flow in the opposite direction, through the open mesh segment 12 first, then over the wearer's head and out of the hat 10 through the gap 20.

When the second embodiment of the present invention is employed, which comprises the insert 22 used with a conventional hat 24, the air will flow over the head most effectively if there is some means for the air to escape the hat near the top thereof. Many conventional hats may already have such a means. For example, the conventional hat may already have an open mesh portion, or the hat may be constructed of such a loosely woven fabric that air may easily pass there-through.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. The scope of the invention is to be limited only by the following claims and their legal equivalents.

The invention claimed is:

1. A hat including a band connected to a first inside portion of the hat and connectable to a second inside portion of the hat, such that the band is inside the hat and against a wearer's forehead when the hat is worn, and a gap is formed between a front of the hat and the band, the hat including an open mesh portion for air to escape from the hat when the hat is worn, at least a part of the open mesh portion being positioned on a top portion of the hat, whereby air may flow naturally by convection into the hat through the gap, and out of the hat through the open mesh portion.

2. The hat of claim 1, wherein the first portion of the hat is a first side of the hat and the second portion of the hat is a second side of the hat.

3. A hat including a band connected to a first inside portion of the hat and connectable to a second inside portion of the hat, such that the band is inside the hat and against a wearer's forehead when the hat is worn, and a crescent-shaped gap is formed between a front of the hat and the band, the gap terminating at the first and second inside portions of the hat, the hat including an air passage means for air to escape from the hat when the hat is worn, whereby air may flow naturally by convection into the hat through the gap, and out of the hat through the air passage means.

4. The hat of claim 3, wherein the first portion of the hat is a first side of the hat and the second portion of the hat is a second side of the hat.

5. The hat of claim 3, wherein the air passage means is an open mesh portion of the hat.

6. The hat of claim 3, wherein the air passage means is an open mesh portion of the hat positioned at least partially on a top portion of the hat.

7. The hat of claim 3, wherein the air passage means is an open mesh portion of the hat positioned at least partially on a top rear portion of the hat.

8. A hat including a band connected to a first inside portion of the hat and connected to a second inside portion of the hat, such that the band is inside the hat and against a wearer's forehead when the hat is worn, and a crescent-shaped gap is formed between a front of the hat and the band, the gap terminating at the first and second inside portions of the hat, the hat including an air passage means for air to escape from the hat when the hat is worn, whereby air may flow naturally by convection into the hat through the gap, and out of the hat through the air passage means.

9. The hat of claim 8, wherein the first portion of the hat is a first side of the hat and the second portion of the hat is a second side of the hat.

10. The hat of claim 8, wherein the air passage means is an open mesh portion of the hat.

11. The hat of claim 8, wherein the air passage means is an open mesh portion of the hat positioned at least partially on a top portion of the hat.

12. The hat of claim 8, wherein the air passage means is an open mesh portion of the hat positioned at least partially on a top rear portion of the hat.

* * * * *